US009836013B2

(12) United States Patent
Tanaka

(10) Patent No.: US 9,836,013 B2
(45) Date of Patent: Dec. 5, 2017

(54) IMAGE FORMING APPARATUS, IMAGE FORMING SYSTEM AND LUBRICANT AMOUNT ADJUSTING METHOD

(71) Applicant: KONICA MINOLTA, INC., Chiyoda-ku, Tokyo (JP)

(72) Inventor: Hideaki Tanaka, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/218,555

(22) Filed: Jul. 25, 2016

(65) Prior Publication Data

US 2017/0038725 A1 Feb. 9, 2017

(30) Foreign Application Priority Data

Aug. 5, 2015 (JP) ..... 2015-154901

(51) Int. Cl.
*G03G 21/00* (2006.01)

(52) U.S. Cl.
CPC ..... *G03G 21/0094* (2013.01); *G03G 21/0076* (2013.01)

(58) Field of Classification Search
CPC ..... G03G 21/0094; G03G 21/0076
See application file for complete search history.

(56) References Cited

U.S. PATENT DOCUMENTS 4,870,466 A 9/1989 Iida
6,954,609 B2 10/2005 Ito
7,286,785 B2 * 10/2007 Hashimoto ..... G03G 15/161 399/101
7,362,996 B2 * 4/2008 Facci ..... G03G 21/0011 399/346
8,737,885 B1 * 5/2014 Berg ..... G03G 15/0815 399/249
2004/0057761 A1 3/2004 Ito
2010/0046974 A1 * 2/2010 Gross ..... G03G 21/0011 399/71
2012/0087704 A1 * 4/2012 Asaoka ..... G03G 15/0131 399/350

(Continued)

FOREIGN PATENT DOCUMENTS

JP 63141087 A 6/1988
JP 2003043890 A 2/2003

(Continued)

OTHER PUBLICATIONS

Japanese Office Action (and English translation thereof) dated Jun. 27, 2017 issued in counterpart Japanese Application No. 2015-154901.

*Primary Examiner* — Rodney Bonnette
(74) *Attorney, Agent, or Firm* — Holtz, Holtz & Volek PC

(57) ABSTRACT

An image forming apparatus includes: an image bearing member that is rotatable and supplied with toner to which lubricant has been added; a first cleaning section configured to remove the toner remaining on the image bearing member; a second cleaning section configured to remove the toner remaining on the image bearing member and left without being removed by the first cleaning section; and a control section that performs control to change removing performance in the first cleaning section.

20 Claims, 7 Drawing Sheets

(56) References Cited

U.S. PATENT DOCUMENTS

| | | | | |
|---|---|---|---|---|
| 2012/0224870 | A1* | 9/2012 | Kikuchi | G03G 15/161 399/44 |
| 2014/0119759 | A1* | 5/2014 | Yamaura | G03G 15/168 399/66 |
| 2014/0193172 | A1* | 7/2014 | Tawada | G03G 21/0017 399/111 |
| 2015/0072148 | A1* | 3/2015 | Hayashi | G03G 15/162 428/411.1 |

FOREIGN PATENT DOCUMENTS

| | | | |
|---|---|---|---|
| JP | 2004139044 | A | 5/2004 |
| JP | 2005257787 | A | 9/2005 |
| JP | 2010026100 | A | 2/2010 |
| JP | 2011112665 | A | 6/2011 |
| JP | 2013137399 | A | 7/2013 |

* cited by examiner

IMAGE FORMING APPARATUS, IMAGE FORMING SYSTEM AND LUBRICANT AMOUNT ADJUSTING METHOD

CROSS REFERENCE TO RELATED APPLICATIONS

This application is entitled to and claims the benefit of Japanese Patent Application 2015-154901, filed on Aug. 5, 2015, the disclosure of which including the specification, drawings and abstract is incorporated herein by reference in its entirety.

BACKGROUND OF THE INVENTION

1. Field of the Invention

The present invention relates to an image forming apparatus, an image forming system and a lubricant amount adjusting method.

2. Description of Related Art

In an image forming apparatus using an electrophotographic scheme, a cleaning device of a blade-cleaning type is known in which a plate-shaped cleaning blade composed of an elastic body and serving as a device for removing remaining toner such as untransferred toner and transfer residual toner on an image bearing member (for example, photoconductor) is brought into contact with the surface of the image bearing member to thereby remove the remaining toner on the image bearing member, for example.

In recent years, reduction of toner particle size has been demanded from the view point of enhancing the image quality, and for such a purpose, polymerization methods such as an emulsion polymerization method and a suspension polymerization method have been utilized, for example. As the size of the toner particle decreases, however, the attaching force between the toner particle and the image bearing member increases, thus reducing the ease of removal of the remaining toner on the image bearing member. In particular, when a so-called polymerization toner produced by a polymerization method is used, the toner particles have a substantially spherical shape, and as a result cleaning failures in which the toner particles roll on the image bearing member and slip through the cleaning blade are easily caused, thus further reducing the ease of removal of the remaining toner on the image bearing member.

In addition, when toner slips through the cleaning blade, the toner becomes the core of toner aggregate formed on the image bearing member, and grain blank (raindrop) is generated on the solid image printing part. To solve such a quality problem as the above-mentioned "raindrop" today, lubricant (e.g., metal soap of metal stearate) is supplied onto the image bearing member to form coating of the lubricant such that cleaning is performed in the state where the attaching force between the toner particle and the image bearing member is suppressed to a low level. Examples of the mechanism for supplying lubricant on the image bearing member include a lubricant application process in which a brush is brought into contact with lubricant formed in a rod shape to scrape the lubricant and supply the lubricant to the surface of the image bearing member, a toner adding process in which a toner image is formed with use of toner containing lubricant-external additive (lubricant) to supply the lubricant or a process combining the lubricant application process and the toner adding process.

The image forming apparatus provided with the lubricant supply mechanism supplies lubricant onto the surface of the image bearing member and thereby reduces a frictional coefficient with respect to the toner on the surface of the image bearing member. When transferring the toner image formed on the surface of the image bearing member to a transfer member (e.g., intermediate transfer belt), this makes it possible to suppress the occurrence of transfer failures and improve the image quality of the toner image. It is also possible to reduce the frictional coefficient between the cleaning blade or the like brought into pressure-contact with the image bearing member and the image bearing member, and thereby suppress shaving (abrasion) of the surface layer of the image bearing member, and eventually extend the service life of the image bearing member.

For example, Japanese Patent Application Laid-Open No. 2011-112665 discloses a toner removing section configured to dispose a cleaning brush on an upstream side of a cleaning blade in a rotational direction of an image bearing member and remove remaining toner before reaching the cleaning blade using the cleaning brush.

An insufficient amount of lubricant coated onto the image bearing member may produce problems such as cleaning failures, granular noise, stripe image irregularity, and on the other hand, an excessive amount of lubricant may produce problems such as reduction of durability of the cleaning blade due to adhesive wear and image degradation due to mixture of lubricant from the developing section to the developer, and therefore an appropriate amount exists for the amount of lubricant. Moreover, a difference in the amount of lubricant may produce unevenness in image concentration or image quality, and it is therefore necessary to maintain the amount of lubricant stably and to within an appropriate range in order to stabilize the image concentration or image quality.

The toner adding process does not require a coating device such as a lubricant rod and a brush, and therefore is advantageous in terms of installation space and cost. In the toner adding process, however, the amount of the lubricant in the developing device varies depending on the amount of toner consumption, and as a result the amount of the lubricant to be applied onto the image bearing member varies. The amount of the lubricant to be coated onto the image bearing member is determined by a balance between the "supply amount" of the lubricant supplied onto the image bearing member and the "collection amount" of the lubricant scraped and collected after being supplied onto the image bearing member. In the toner adding process, since the lubricant is supplied from a developer, when a high coverage image is printed, the supply amount of the lubricant increases, whereas when a low coverage image is printed, the supply amount of the lubricant decreases. Originally, the lubricant is supplied only to parts on the image bearing member to which toner is supplied. However, there is actually lubricant which detaches from toner and becomes independent as well due to the influence of a load during stirring in the developing device and an electric field load in a transfer section (development region), and the lubricant is also supplied to a white base where there is no image.

On the other hand, the cleaning blade which is in contact with the image bearing member has a large effect on the amount of lubricant collected and the lubricant is scraped and collected by a friction with the toner (mainly external additive component) blocked by a blade edge section at which the cleaning blade is in contact with the image bearing member. Furthermore, the amount of lubricant collection varies depending on the amount of toner supplied to the blade edge section as well, the greater the amount of toner supplied, the greater the amount of lubricant collected becomes, whereas the smaller the amount of toner supplied, the smaller the amount of lubricant collected becomes. That is, the amount of lubricant collection increases when a high coverage image is printed and the amount of lubricant collection decreases when a low coverage image is printed.

As described above, the relationship between the supply and collection of lubricant varies depending on the coverage of an image to be printed, and by extension, there is a difference in the amount of lubricant coated onto the image bearing member depending on the ratio of the supply and collection, resulting in a problem in that it is not possible to maintain the amount of lubricant coated onto the image bearing member to within an appropriate range.

Note that the technique according to Japanese Patent Application Laid-Open No. 2011-112665 is a technique for reducing the amount of toner supplied to the blade edge section and is not a technique for preventing the occurrence of a difference in the amount of lubricant coated onto the image bearing member depending on the coverage of an image to be printed. That is, the technique described in Japanese Patent Application Laid-Open No. 2011-112665 is not intended to maintain the amount of lubricant coated onto the image bearing member to within an appropriate range, and thus does not have the configuration therefor.

SUMMARY OF THE INVENTION

An object of the present invention is to provide an image forming apparatus, an image forming system and a lubricant amount adjusting method capable of maintaining an amount of lubricant coated onto an image bearing member within an appropriate range.

To achieve the abovementioned object, an image forming apparatus reflecting one aspect of the present invention includes: an image bearing member that is rotatable and supplied with toner to which lubricant has been added; a first cleaning section configured to make contact with the image bearing member and remove the toner remaining on the image bearing member; a second cleaning section provided on a downstream side of the first cleaning section in a rotational direction of the image bearing member and configured to make contact with the image bearing member and remove the toner remaining on the image bearing member and left without being removed by the first cleaning section; and a control section configured to perform control to change removing performance in the first cleaning section based on toner consumption information relating to the amount of toner consumption.

Desirably, in the image forming apparatus, the control section performs control so that the removing performance of the first cleaning section when the amount of toner consumption is small becomes higher than the removing performance of the first cleaning section when the amount of toner consumption is large.

Desirably, in the image forming apparatus, the toner consumption information is a coverage rate of an input image of an image forming target, and the control section performs control so that the removing performance of the first cleaning section when the coverage rate is low becomes higher than the removing performance of the first cleaning section when the coverage rate is high.

Desirably, in the image forming apparatus, the coverage rate is an average coverage rate per predetermined number of printed sheets.

Desirably, in the image forming apparatus, the control section changes a relative moving speed of the first cleaning section with respect to the image bearing member to thereby perform control to change the removing performance in the first cleaning section.

Desirably, the image forming apparatus further includes a voltage application section configured to apply a voltage to the first cleaning section, in which the control section changes the voltage to thereby perform control to change the removing performance in the first cleaning section.

Desirably, the image forming apparatus further includes a charging amount adjusting section provided on an upstream side of the first cleaning section in the rotational direction of the image bearing member and configured to charge the toner remaining on the image bearing member, in which the control section changes the amount of charge of the toner to thereby perform control to change the removing performance in the first cleaning section.

Desirably, in the image forming apparatus, the control section performs control to change the removing performance in the first cleaning section between a first supply timing at which toner is supplied to an image forming region on the image bearing member and a second supply timing at which toner is supplied between the image forming regions on the image bearing member.

Desirably, in the image forming apparatus, the first cleaning section is a brush which is rotatable while in contact with the image bearing member.

Desirably, in the image forming apparatus, the first cleaning section is a roller which is rotatable while in contact with the image bearing member.

Desirably, in the image forming apparatus, the first cleaning section is a belt capable of running while in contact with the image bearing member.

In addition, to achieve the abovementioned object, an image forming system reflecting one aspect of the present invention is composed of a plurality of units including an image forming apparatus, the image forming system including: an image bearing member that is rotatable and supplied with toner to which lubricant has been added; a first cleaning section configured to make contact with the image bearing member and remove the toner remaining on the image bearing member; a second cleaning section provided on a downstream side of the first cleaning section in a rotational direction of the image bearing member and configured to make contact with the image bearing member and remove the toner remaining on the image bearing member and left without being removed by the first cleaning section; and a control section configured to perform control to change removing performance in the first cleaning section based on toner consumption information relating to the amount of toner consumption.

Desirably, in the image forming system, the control section performs control so that the removing performance of the first cleaning section when the amount of toner consumption is small becomes higher than the removing performance of the first cleaning section when the amount of toner consumption is large.

Desirably, in the image forming system, the toner consumption information is a coverage rate of an input image of an image forming target, and the control section performs control so that the removing performance of the first cleaning section when the coverage rate is low becomes higher than the removing performance of the first cleaning section when the coverage rate is high.

Desirably, in the image forming system, the coverage rate is an average coverage rate per predetermined number of printed sheets.

Desirably, in the image forming system, the control section changes a relative moving speed of the first cleaning section with respect to the image bearing member to thereby perform control to change the removing performance in the first cleaning section.

Desirably, in the image forming system further includes a voltage application section configured to apply a voltage to the first cleaning section, in which the control section changes the voltage to thereby perform control to change the removing performance in the first cleaning section.

Desirably, in the image forming system further includes a charging amount adjusting section provided on an upstream side of the first cleaning section in the rotational direction of the image bearing member and configured to charge the toner remaining on the image bearing member, in which the control section changes the amount of charge of the toner to thereby perform control to change the removing performance in the first cleaning section.

Desirably, in the image forming system, the control section performs control to change the removing performance in the first cleaning section between a first supply timing at which toner is supplied to an image forming region on the image bearing member and a second supply timing at which toner is supplied between the image forming regions on the image bearing member.

Moreover, to achieve the abovementioned object, a lubricant amount adjusting method reflecting one aspect of the present invention includes: supplying a rotating image bearing member with toner to which lubricant has been added; removing the toner remaining on the image bearing member by causing a first cleaning section to make contact with the image bearing member; causing a second cleaning section to make contact with the image bearing member on a downstream side of the first cleaning section in a rotational direction of the image bearing member and thereby remove the toner remaining on the image bearing member and left without being removed by the first cleaning section; and changing removing performance in the first cleaning section based on toner consumption information relating to the amount of toner consumption.

BRIEF DESCRIPTION OF DRAWINGS

FIG. 3 schematically illustrates a configuration of a toner removing section or the like;

FIG. 5 schematically illustrates a modification of the configuration of the toner removing section or the like;

DESCRIPTION OF THE PREFERRED EMBODIMENTS

Figure 1:
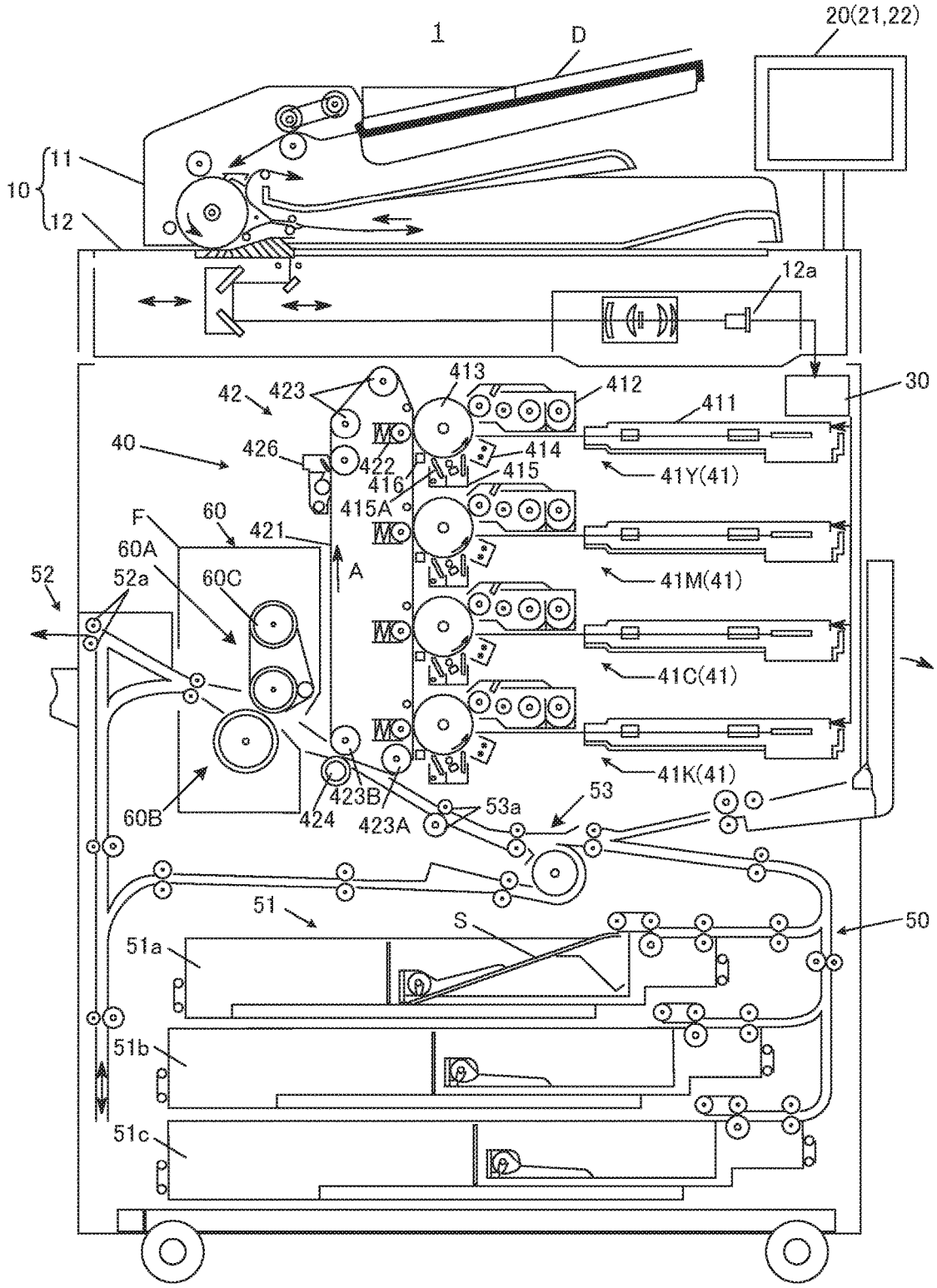
FIG. 1 schematically illustrates an entire configuration of an image forming apparatus according to the present embodiment.
Figure 2:
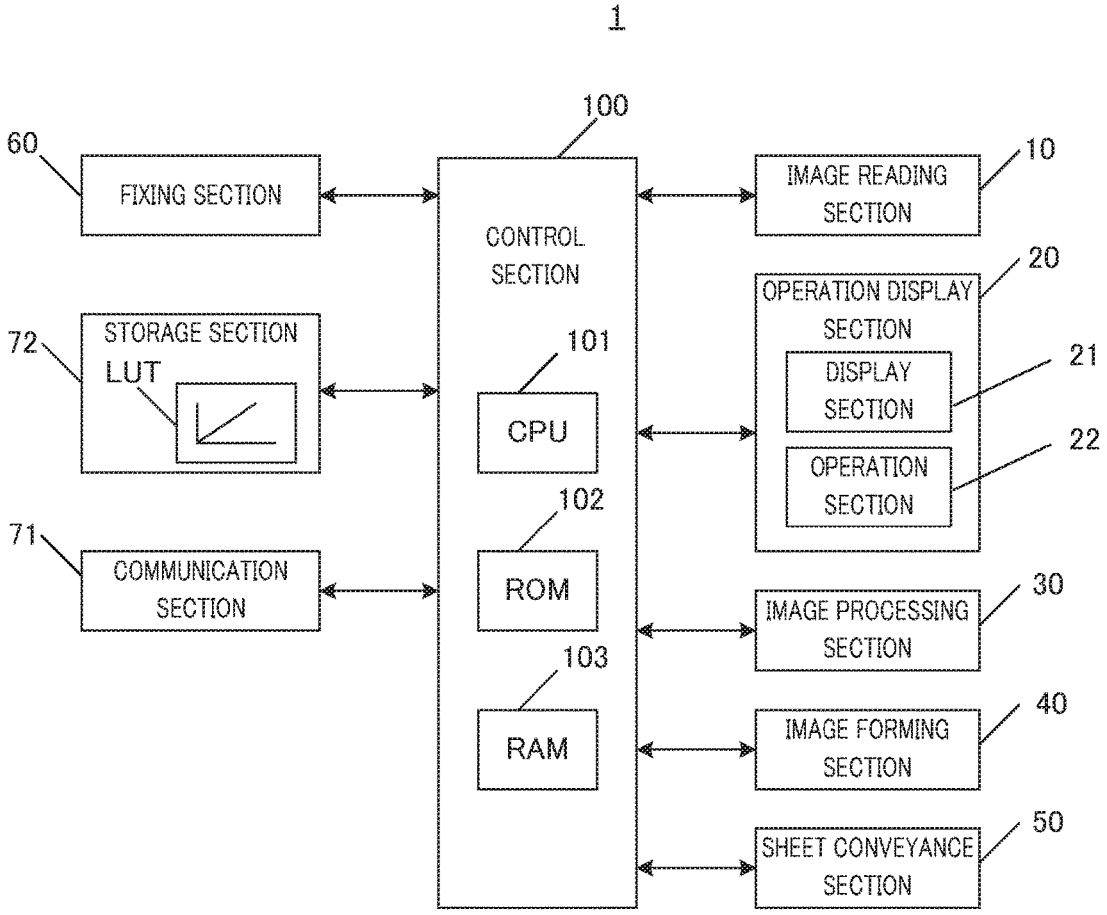
FIG. 2 illustrates a principal part of a control system of the image forming apparatus according to the present embodiment.

Hereinafter, an embodiment of the present invention will be described in detail with reference to the accompanying drawings. FIG. 1 schematically illustrates an entire configuration of image forming apparatus 1 according to the embodiment of the present invention. FIG. 2 illustrates a principal part of a control system of image forming apparatus 1 according to the present embodiment. Image forming apparatus 1 illustrated in FIGS. 1 and 2 is a color image forming apparatus of an intermediate transfer system using electrophotographic process technology. That is, image forming apparatus 1 transfers (primary-transfers) toner images of colors of Y (yellow), M (magenta), C (cyan) and K (black) formed on photoconductor drum 413 (corresponding to "image bearing member" of the present invention) to intermediate transfer belt 421, superimposes the four color toner images one on another on intermediate transfer belt 421, then transfers (secondary-transfers) them to sheet S and thereby forms an image.

A tandem scheme is adopted for image forming apparatus 1, in which photoconductor drums 413 corresponding to four YMCK colors are arranged in series in a traveling direction of intermediate transfer belt 421 and toner images of the respective colors are sequentially transferred to intermediate transfer belt 421 in one cycle.

As illustrated in FIG. 2, image forming apparatus 1 includes image reading section 10, operation display section 20, image processing section 30, image forming section 40, sheet conveyance section 50, fixing section 60 and control section 100.

Control section 100 includes central processing unit (CPU) 101, read only memory (ROM) 102, random access memory (RAM) 103 and the like. CPU 101 reads a program suited to processing contents out of ROM 102, deploys the program in RAM 103, and integrally controls an operation of each block of image forming apparatus 1 in cooperation with the deployed program. At this time, CPU 101 refers to various kinds of data stored in storage section 72. Storage section 72 is composed of, for example, a non-volatile semiconductor memory (so-called flash memory) or a hard disk drive. In the present embodiment, storage section 72 stores history information that represents the history of toner image formation of image forming section 40 ("toner consumption information" of the present invention). The history information includes information on the number of prints and the coverage rate the like. The coverage rate includes an average coverage rate per predetermined number of prints.

Control section 100 transmits and receives various kinds of data to and from an external apparatus (for example, a personal computer) connected to a communication network such as a local area network (LAN) or a wide area network (WAN), through communication section 71. Control section 100 receives, for example, image data transmitted from the external apparatus, and performs control to form an image on sheet S on the basis of the image data (input image data). Communication section 71 is composed of, for example, a communication control card such as a LAN card.

Image reading section 10 includes auto document feeder (ADF) 11, document image scanning device 12 (scanner), and the like.

Auto document feeder 11 causes a conveyance mechanism to feed document D placed on a document tray, and sends out document D to document image scanner 12. Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and images light reflected from the document on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

Operation display section 20 includes, for example, a liquid crystal display (LCD) with a touch panel, and functions as display section 21 and operation section 22. Display section 21 displays various operation screens, image conditions, operating statuses of functions, and the like in accordance with display control signals received from control section 100. Operation section 22 includes various operation keys such as numeric keys and a start key, receives various input operations performed by a user, and outputs operation signals to control section 100.

Image processing section 30 includes a circuit that performs a digital image process suited to initial settings or user settings on the input image data, and the like. For example, image processing section 30 performs tone correction on the basis of tone correction data (tone correction table), under the control of control section 100. In addition to the tone correction, image processing section 30 also performs various correction processes such as color correction and shading correction as well as a compression process, on the input image data. Image forming section 40 is controlled on the basis of the image data that has been subjected to the processes.

Image forming section 40 includes image forming units 41Y, 41M, 41C, and 41K that form images of colored toners of a Y component, an M component, a C component, and a K component on the basis of the input image data, intermediate transfer unit 42, and the like.

Image forming units 41Y, 41M, 41C, and 41K for the Y component, the M component, the C component, and the K component have a similar configuration. For ease of illustration and description, common elements are denoted by the same reference numerals. Only when elements need to be discriminated from one another, Y, M, C, or K is added to their reference numerals. In FIG. 1, reference numerals are given to only the elements of image forming unit 41Y for the Y component, and reference numerals are omitted for the elements of other image forming units 41M, 41C, and 41K.

Image forming unit 41 includes exposure device 411, developing device 412, photoconductor drum 413, charging apparatus 414, drum cleaning device 415 (corresponding to the "second cleaning section" of the present invention) and toner removing section 416 (corresponding to the "first cleaning section" of the present invention), and the like.

Photoconductor drum 413 is composed of an organic photoconductor in which a photosensitive layer made of a resin containing an organic photoconductive member is formed on the outer peripheral surface of a drum-like metal base, for example. Examples of the resin of the photosensitive layer include polycarbonate resin, silicone resin, polystyrene resin, acrylic resin, methacryl resin, epoxy resin, polyurethane resin, chloride vinyl resin, melamine resin and the like.

Control section 100 controls a driving current supplied to a driving motor (not shown in the drawings) that rotates photoconductor drums 413, whereby photoconductor drums 413 are rotated at a constant circumferential speed.

Charging device 414 is, for example, a charging charger and causes corona discharge to thereby evenly negatively charge the surface of photoconductor drum 413 having photoconductivity.

Exposure device 411 is composed of, for example, a semiconductor laser, and configured to irradiate photoconductor drum 413 with laser light corresponding to the image of each color component. As a result, electrostatic latent images for the respective color components are formed on the surface of photoconductor drum 413 due to a potential difference from the surrounding area.

Developing device 412 is a developing device of a two-component reverse type, and attaches toners of respective color components to the surface of photoconductor drums 413, and visualizes the electrostatic latent image to form a toner image. In the present embodiment, lubricant having lubricity is added in the toner. Examples of the lubricant include fatty acid metal salt, silicone oil, fluorine resin and the like, which may be used alone or in combination. Among them, fatty acid metal salt is preferable. The fatty acid is preferably a straight-chain hydrocarbon, and for example, myristic acid, palmitic acid, stearic acid, oleic acid and the like are preferable. Among them, stearic acid is more preferable. Examples of the metal include lithium, magnesium, calcium, strontium, zinc, cadmium, aluminum, celium, titanium, and iron. Among them, zinc stearate, stearic acid magnesium, stearic acid aluminum, stearic acid iron and the like are preferable.

Developing device 412 includes a developing sleeve that is disposed to face photoconductor drum 413 with the development region therebetween. For example, a direct current developing bias having the same polarity as the charging polarity of charging apparatus 414, or a developing bias in which a direct current voltage having the same polarity as the charging polarity of charging apparatus 414 is superimposed on an alternating current voltage is applied to the developing sleeve. Thus, reversal development for attaching toner to an electrostatic latent image formed by exposing device 411 is performed.

Drum cleaning device 415 is brought into contact with the surface of photoconductor drum 413, includes plate-shaped cleaning blade 415A composed of an elastic body and the like, and removes the toner remaining on the surface of photoconductor drum 413 which has not been transferred to intermediate transfer belt 421.

The impact resilience coefficient and the hardness are important physical properties of cleaning blade 415A. The impact resilience coefficient at a temperature of 251[° C.] is preferably 10 to 80[%], more preferably 30 to 70[%]. In addition, the JISA hardness is preferably 20 to 90 degrees, more preferably 60 to 80 degrees. When the JISA hardness is smaller than 20 degrees, cleaning blade 415A is excessively soft, and turn-up of the blade is easily caused. When the JISA hardness is greater than 90 degrees, it is difficult to follow the slight irregularities and foreign matters on photoconductor drum 413, and consequently toner particles may easily slip therethrough. The contact load of cleaning blade 415A on photoconductor drum 413 is preferably 0.1 to 40 [N/m], and more preferably 1 to 25 [N/m]. When the contact load is smaller than 0.1 [N/m], the cleaning force is insufficient, and consequently image fouling is easily caused. When the contact load is greater than 40 [N/m], abrasion between cleaning blade 415A and photoconductor drum 413 is increased, and consequently image blurring and the like are easily caused. Examples of the method for measuring the contact load include a method in which the contact load is measured by pressing the tip of cleaning blade 415A against a balance, a method in which the contact load is electrically measured by disposing a sensor such as a load cell at a position where the tip of cleaning blade 415A makes contact with photoconductor drum 413, and the like.

Figure 3:
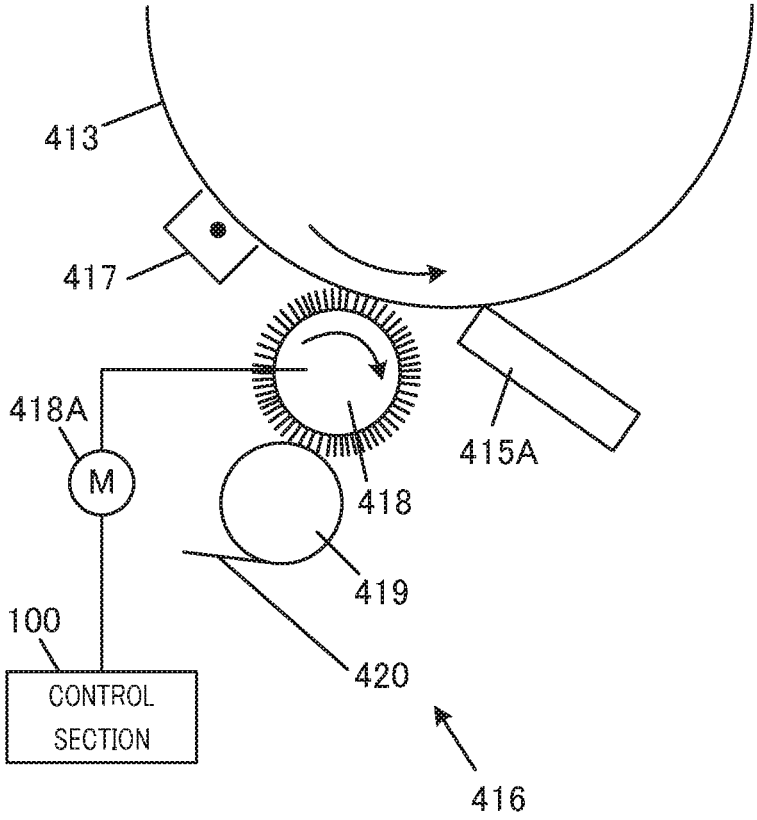

FIG. 3 schematically illustrates a configuration of toner removing section 416, and the like.

As illustrated in FIG. 3, toner removing section 416 includes scorotron charger (corresponding to the "charging amount adjusting section" of the present invention) 417, cleaning brush 418, flicker roller 419 and scraper 420, and the like.

Scorotron charger 417 is provided on the upstream side of cleaning blade 415A in the rotational direction of photoconductor drum 413 and on the downstream side of the primary transfer nip (see FIG. 1), to adjust the amount of charging of the toner remaining on the surface of photoconductor drum 413 without being transferred to intermediate transfer belt 421. Scorotron charger 417 is configured by disposing a scorotron electrode (small-diameter wire electrode or saw-tooth electrode) in a region surrounded by a shielding body and disposing a mesh-like grid electrode (not shown) between the scorotron electrode and photoconductor drum 413. Scorotron charger 417 applies a high voltage of, for example, DC+500 [V] to the scorotron electrode, thereby causes corona discharge to locally bring about air breakdown, discharges charge and adds charge having a polarity (plus polarity) opposite to a charge polarity (minus polarity) of the surface of photoconductor drum 413 to the remaining toner on photoconductor drum 413. Note that the charging amount adjusting section is not limited to scorotron charger 417, and may be anything that can adjust the amount of charging of the toner such as corotron charger using corona discharge, charge eliminator, destaticizing cloth using non-woven fabric cloth, and the like or electrode or roller placed so as to face photoconductor drum 413 across a minute cavity or contact type roller. The voltage applied when adjusting the amount of charging may be any one of a DC voltage, AC voltage, and an AC voltage superimposed on a DC voltage. Since scorotron charger 417 is means for adjusting the amount of charging of the toner that reaches cleaning brush 418, scorotron charger 417 may be disposed at any position on the downstream of developing device 412, on the upstream side of cleaning brush 418 in the rotational direction of photoconductor drum 413.

As illustrated in FIG. 3, cleaning brush 418 is provided on the upstream side of cleaning blade 415A and on the downstream side of scorotron charger 417 in the rotational direction of photoconductor drum 413 to eliminate the remaining toner on photoconductor drum 413.

Cleaning brush 418 includes a rotatable member and a plurality of elastic conductive fibers (e.g., acrylic resin) implanted into the surface. Cleaning brush 418 rotates while in contact with photoconductor drum 413 and thereby picks up the remaining toner from the surface of photoconductor drum 413. Control section 100 controls the driving current supplied to driving motor 418A that drives cleaning brush 418 to rotate and thereby adjusts the rotation speed of cleaning brush 418.

Flicker roller 419 rotates while in contract with cleaning brush 418 and thereby collects the remaining toner picked up by cleaning brush 418 to the surface of flicker roller 419.

Scraper 420 has a plate-like shape and is pressed against the surface of flicker roller 419 with a distal end portion thereof oriented toward a direction facing the rotational direction (counter direction) of flicker roller 419. When flicker roller 419 rotates, the remaining toner collected in flicker roller 419 and attached to the surface is scraped and taken out by scraper 420.

Intermediate transfer unit 42 includes intermediate transfer belt 421, primary transfer roller 422, a plurality of support rollers 423, secondary transfer roller 424, belt cleaning device 426 and the like.

Intermediate transfer belt 421 is composed of an endless belt, and is stretched around the plurality of support rollers 423 in a loop form. At least one of the plurality of support rollers 423 is composed of a driving roller, and the others are each composed of a driven roller. Preferably, for example, roller 423A disposed on the downstream side in the belt traveling direction relative to primary transfer rollers 422 for K-component is a driving roller. With this configuration, the travelling speed of the belt at a primary transfer nip can be easily maintained at a constant speed. When driving roller 423A rotates, intermediate transfer belt 421 travels in arrow A direction at a constant speed.

Intermediate transfer belt 421 is a belt having conductivity and elasticity which includes on the surface thereof a high resistance layer having a volume resistivity of 8 to 11 [log Ω·cm]. Intermediate transfer belt 421 is rotationally driven by a control signal from control section 100. Note that the material, thickness and hardness of intermediate transfer belt 421 are not limited as long as intermediate transfer belt 421 has conductivity and elasticity.

Primary transfer rollers 422 are disposed to face photoconductor drums 413 of respective color components, on the inner periphery side of intermediate transfer belt 421. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face backup roller 423B disposed on the downstream side in the belt travelling direction relative to driving roller 423A, on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to sheet S is formed.

When intermediate transfer belt 421 passes through the primary transfer nip, the toner images on photoconductor drums 413 are sequentially primary-transferred to intermediate transfer belt 421. More specifically, a primary transfer bias is applied to primary transfer rollers 422, and an electric charge of the polarity opposite to the polarity of the toner is applied to the rear side (the side that makes contact with primary transfer rollers 422) of intermediate transfer belt 421, whereby the toner image is electrostatically transferred to intermediate transfer belt 421.

Thereafter, when sheet S passes through the secondary transfer nip, the toner image on intermediate transfer belt 421 is secondary-transferred to sheet S. To be more specific, a secondary transfer bias is applied to secondary transfer roller 424, and an electric charge of the polarity opposite to the polarity of the toner is applied to the rear side (the side that makes contact with secondary transfer roller 424) of sheet S, whereby the toner image is electrostatically transferred to sheet S. Sheet S on which the toner images have been transferred is conveyed toward fixing section 60.

Belt cleaning device 426 removes transfer residual toner which remains on the surface of intermediate transfer belt 421 after a secondary transfer. A configuration (so-called belt-type secondary transfer unit) in which a secondary transfer belt is installed in a stretched state in a loop form around a plurality of support rollers including a secondary transfer roller may also be adopted in place of secondary transfer roller 424.

Fixing section 60 includes upper fixing section 60A having a fixing side member disposed on a fixing surface (the surface on which a toner image is formed) side of sheet S, lower fixing section 60B having a back side supporting member disposed on the rear surface (the surface opposite to the fixing surface) side of sheet S, heating source 60C, and the like. The back side supporting member is brought into pressure contact with the fixing side member, whereby a fixing nip for conveying sheet S in a tightly sandwiching manner is formed.

Fixing section 60 applies, at the fixing nip, heat and pressure to sheet S on which a toner image has been secondary-transferred, thereby fixing the toner image on sheet S. Fixing section 60 is disposed as a unit in fixing part F. In addition, fixing part F may be provided with an air-separating unit that blows air to separate sheet S from the fixing side member or the back side supporting member.

Sheet conveyance section 50 includes sheet feeding section 51, sheet ejection section 52, conveyance path section 53 and the like. Three sheet feed tray units 51*a* to 51*c* included in sheet feeding section 51 store sheets S (standard sheets, special sheets) discriminated on the basis of the basis weight, the size, and the like, for each type set in advance. Conveyance path section 53 includes a plurality of pairs of conveyance rollers such as a pair of resist rollers 53*a*.

Sheets S stored in sheet tray units 51*a* to 51*c* are outputted one by one from the uppermost, and conveyed to image forming section 40 by conveyance path section 53. At this time, the resist roller section in which the pair of resist rollers 53*a* is arranged corrects skew of sheet S fed thereto, and the conveyance timing is adjusted. Then, in image forming section 40, the toner image on intermediate transfer belt 421 is secondary-transferred to one side of sheet S at once, and a fixing process is performed in fixing section 60. Sheet S on which an image has been formed is ejected out of the image forming apparatus by sheet ejection section 52 including sheet ejection rollers 52*a*.

An insufficient amount of lubricant coated onto photoconductor drum 413 may cause problems such as a cleaning failure, grain noise, stripe image irregularity, and an excessive amount of lubricant may cause problems such as deterioration of durability of cleaning blade 415A due to adhesive wear or image degradation due to a mixture of lubricant from the developing section into the developer, and therefore an appropriate amount exists for the amount of lubricant. Moreover, a difference in the amount of lubricant may produce unevenness in image concentration or image quality, and it is therefore necessary to maintain the amount of lubricant stably and to within an appropriate range in order to stabilize the image concentration or image quality.

Since the present embodiment adopts the toner adding process in which a toner image is formed using lubricant-containing toner and the lubricant is supplied, the amount of lubricant in developing device 412 varies depending on the amount of toner consumption, and as a result, the amount of lubricant coated onto photoconductor drum 413 varies. The amount of lubricant coated onto photoconductor drum 413 is determined by a balance between the "supply amount" of the lubricant supplied onto photoconductor drum 413 and the "collection amount" of the lubricant supplied onto photoconductor drum 413 and then scraped and collected. In the toner adding process, since the lubricant is supplied from the developer, when a high coverage image is printed, the amount of lubricant supplied increases, whereas when a low coverage image is printed, the amount of lubricant supplied decreases.

On the other hand, cleaning blade 415A which is in contact with photoconductor drum 413 has a large effect on the amount of lubricant collected and the lubricant is scraped and collected by a friction with the toner (mainly external additive component) blocked by the blade edge section at which cleaning blade 415A is in contact with photoconductor drum 413. Furthermore, the amount of lubricant collected also varies depending on the amount of toner supplied to the blade edge section, and the amount of lubricant collected increases as the amount of lubricant toner supplied increases, whereas the amount of lubricant collected decreases as the amount of toner supplied decreases. That is, the amount of lubricant collection increases when a high coverage image is printed and the amount of lubricant collection decreases when a low coverage image is printed.

As described above, the relationship between the supply and collection of lubricant varies depending on the coverage of an image to be printed, and by extension, there is a difference in the amount of lubricant coated onto photoconductor drum 413 depending on the ratio of the supply and collection, resulting in a problem in that it is not possible to maintain the amount of lubricant coated onto photoconductor drum 413 to within an appropriate range.

Thus, in the present embodiment, control section 100 changes toner removing performance of toner removing section 416 based on the coverage rate of an input image to be imaged as toner consumption information and thereby performs control for adjusting the amount of lubricant coated onto photoconductor drum 413 (hereinafter referred to as "lubricant amount adjusting control").

More specifically, control section 100 controls the driving current supplied to driving motor 418A, changes a relative moving speed (linear speed ratio) of cleaning brush 418 with respect to photoconductor drum 413 and thereby changes the toner removing performance. Here, the "relative moving speed" refers to a relative moving distance per unit time of cleaning brush 418 with respect to photoconductor drum 413 at a position at which cleaning brush 418 comes into contact with photoconductor drum 413. Note that the speed of cleaning brush 418 and the speed of photoconductor drum 413 at the contacting position will be described below as their respective circumferential speeds. The "toner removing performance" refers to performance of cleaning brush 418 that removes remaining toner on photoconductor drum 413.

When the coverage rate of the input image is low, control section 100 performs control to increase the toner removing performance. More specifically, control section 100 controls the driving current supplied to driving motor 418A so as to increase the relative moving speed of cleaning brush 418 with respect to photoconductor drum 413. This causes the contact area per unit time between cleaning brush 418 and photoconductor drum 413 to increase, and cleaning brush 418 scrapes more remaining toner on photoconductor drum 413. A small amount of remaining toner which has not been scraped but left on photoconductor drum 413 reaches cleaning blade 415A and is blocked by the blade edge section of cleaning blade 415A. When the amount of remaining toner blocked by the blade edge section decreases, the amount of lubricant collection decreases. Therefore, although the amount of lubricant supplied decreases, the amount of lubricant collection also decreases, and therefore the amount of lubricant on photoconductor drum 413 is maintained within an appropriate range without becoming excessively low.

On the other hand, when the coverage rate of the input image is high, control section 100 performs control to lower the toner removing performance. More specifically, control section 100 controls the driving current supplied to driving motor 418A so as to lower the relative moving speed of cleaning brush 418 with respect to photoconductor drum 413. This causes the contact area per unit time between cleaning brush 418 and photoconductor drum 413 to decrease, and therefore cleaning brush 418 scrapes less remaining toner on photoconductor drum 413. A large volume of remaining toner which has not been scraped but left on photoconductor drum 413 reaches cleaning blade 415A and is blocked by the blade edge section of cleaning blade 415A. When the amount of remaining toner blocked by the blade edge section increases, the amount of lubricant collection increases. Therefore, although the amount of lubricant supplied increases, the amount of lubricant collection also increases, and therefore the amount of lubricant on photoconductor drum 413 is maintained within an appropriate range without becoming excessively high.

Figure 4:
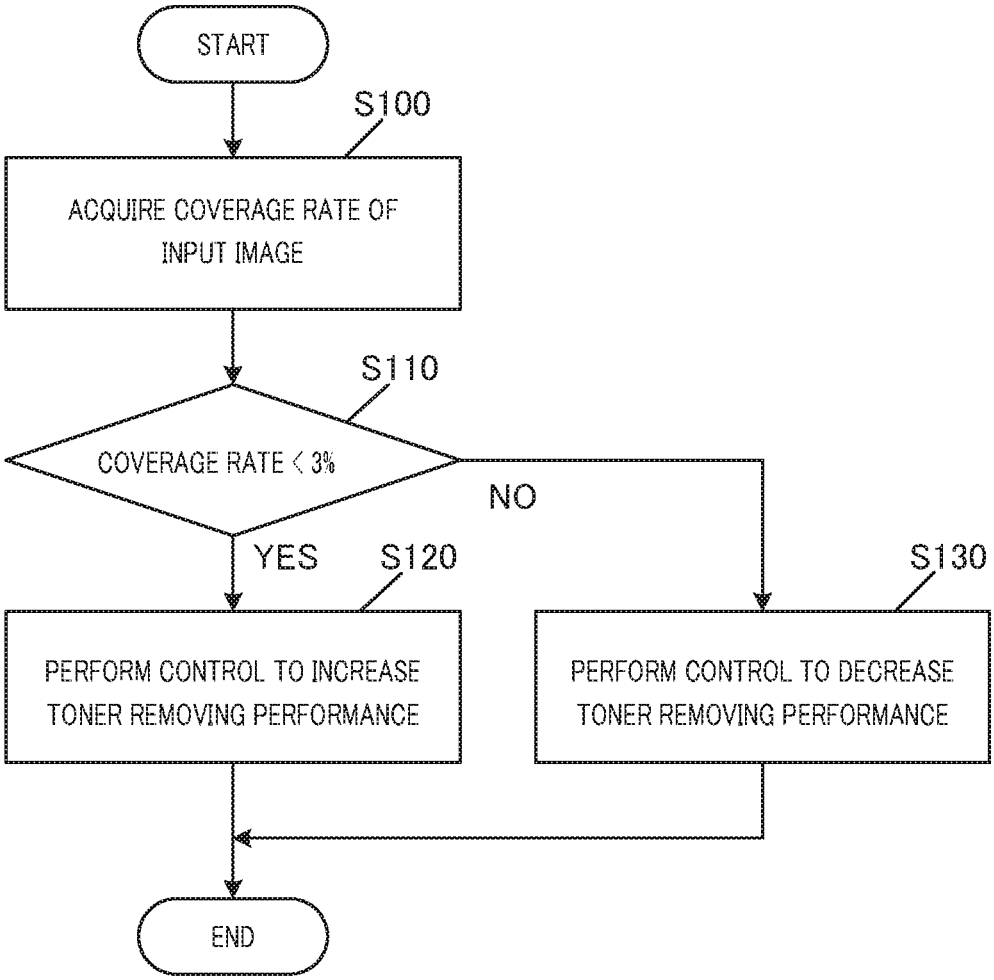
FIG. 4 is a flowchart of a lubricant amount adjusting control operation of the image forming apparatus according to the present embodiment.

FIG. 4 is a flowchart of the lubricant amount adjusting control operation of image forming apparatus 1 according to the present embodiment. The processing in FIG. 4 is executed, for example, every time control section 100 receives an instruction for executing a printing job.

First, control section 100 acquires a coverage rate of the input image corresponding to the printing job stored in storage section 72 (step S100). The coverage rate of the input image is, for example, an average coverage rate per predetermined number of prints.

Next, at step S100, control section 100 determines whether the acquired coverage rate is less than 31[%] (step S110).

Next, upon determining that the acquired coverage rate is less than 31[%] (that is, the amount of lubricant supplied is small) (step S110: YES), control section 100 controls toner removing section 416 so as to increase the toner removing performance of toner removing section 416 (step S120). More specifically, control section 100 controls a driving current supplied to driving motor 418A to increase a relative moving speed of cleaning brush 418 with respect to photoconductor drum 413 and reduce the amount of lubricant collection.

On the other hand, upon determining that the coverage rate is equal to or higher than 31[%] (that is, the amount of lubricant supplied is large) (step S110: NO), control section 100 controls toner removing section 416 so as to lower the toner removing performance of toner removing section 416 (step S130). More specifically, control section 100 controls the driving current supplied to driving motor 418A to lower the relative moving speed of cleaning brush 418 with respect to photoconductor drum 413 and increase the amount of lubricant collection.

As described above in detail, image forming apparatus 1 according to the present embodiment includes photoconductor drum 413, cleaning brush 418 configured to remove remaining toner on photoconductor drum 413, cleaning blade 415A disposed on a downstream side of cleaning brush 418 in a rotational direction of photoconductor drum 413 and configured to scrape the remaining toner on photoconductor drum 413, and control section 100 configured to increase, when the coverage rate of an input image is low, a relative moving speed of cleaning brush 418 with respect to photoconductor drum 413 to decrease the amount of lubricant collection and lower, on the other hand, when the coverage rate of the input image is high, the relative moving speed and increase the amount of lubricant collection.

According to the present embodiment including the configuration described above, even when printing at a low coverage rate continues and the amount of lubricant supplied onto photoconductor drum 413 is small, the amount of lubricant collection also decreases, and so the amount of lubricant is maintained to within an appropriate range without becoming excessively low. On the other hand, even when printing at a high coverage rate continues and the amount of lubricant supplied onto photoconductor drum 413 is large, the amount of lubricant collection also increases, and so the amount of lubricant s maintained within an appropriate range without becoming excessively high.

Figure 5:
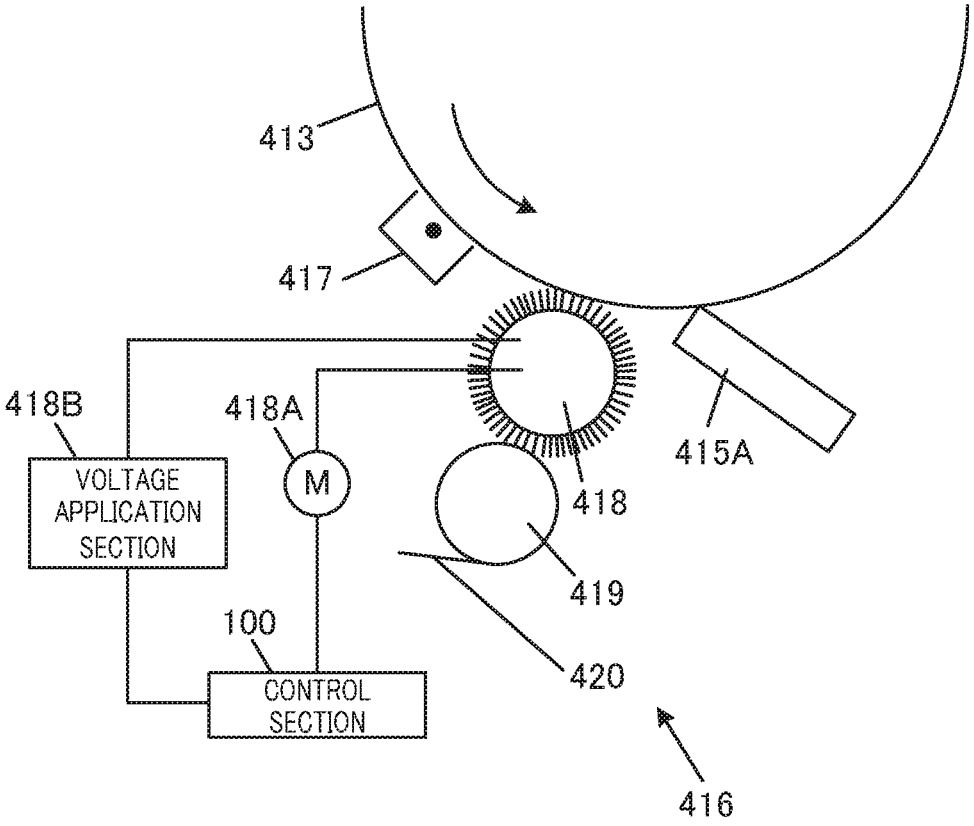

Note that a case has been described in the above embodiment as an example of changing the toner removing performance of toner removing section 416 where a driving current supplied to driving motor 418A that rotates cleaning brush 418 is controlled, but the present invention is not limited to this. As modification 1, toner removing section 416 may be provided with voltage application section 418B configured to apply a bias voltage for electrostatically suctioning the remaining toner to cleaning brush 418 as shown in FIG. 5. Control section 100 performs control so as to change the toner removing performance of toner removing section 416 by changing the bias voltage to be applied to cleaning brush 418.

By applying a bias voltage (e.g., +200 [V]) to cleaning brush 418, electrostatic attraction acts on the remaining toner charged to a negative polarity on photoconductor drum 413 in a direction from photoconductor drum 413 toward cleaning brush 418. Thus, the remaining toner on photoconductor drum 413 can be easily scraped off by cleaning brush 418. Control section 100 then controls voltage application section 418B to increase the bias voltage so as to cause cleaning brush 418 to scrape more remaining toner.

When the coverage rate of the input image is low, control section 100 controls voltage application section 418B so as to increase the bias voltage. As a result, more remaining toner is scraped off by cleaning brush 418.

On the other hand, when the coverage rate of the input image is high, control section 100 controls voltage application section 418B so as to decrease the bias voltage. As a result, less remaining toner is scraped off by cleaning brush 418.

Note that the configurations of the above embodiment and modification 1 may be combined. That is, control section 100 may change the toner removing performance by changing the rotation speed of cleaning brush 418 and changing the bias voltage to be applied to cleaning brush 418.

In addition, a voltage (e.g., +400 [V]) equal to or greater than the bias voltage (bias voltage applied to cleaning brush 418) for electrostatically suctioning the remaining toner may be applied to flicker roller 419. As a result, electrostatic attraction in a direction from cleaning brush 418 toward flicker roller 419 acts on the toner electrostatically suctioned to cleaning brush 418. Thus, the toner electrostatically suctioned to cleaning brush 418 is more easily picked up from cleaning brush 418 to flicker roller 419.

Furthermore, as modification 2, control section 100 may also control the applied voltage of a grid electrode (not shown) of scorotron charger 417 so as to change the amount of charge of the remaining toner.

In modification 2, when the coverage rate of the input image is low, control section 100 may control the applied voltage of the grid electrode so as to lower the amount of charge of the remaining toner, for example. As the charged charge of the remaining toner decreases, the attaching force of the remaining toner to photoconductor drum 413 decreases, and therefore the remaining toner is more likely to be scraped by cleaning brush 418. That is, more remaining toner is removed by cleaning brush 418.

Furthermore, when the coverage rate of the input image is high, control section 100 controls the applied voltage of the grid electrode so that the amount of charge of the remaining toner increases. Since the attaching force of the remaining toner with respect to photoconductor drum 413 increases as the charged charge of the remaining toner increases, the remaining toner is less likely to be scraped by cleaning brush 418. That is, less remaining toner is removed by cleaning brush 418. Note that the configurations of the above embodiment, modification 1 and modification 2 may be combined to perform control to change the toner removing performance.

Furthermore, control section 100 may also perform control to change the toner removing performance based on the amount of lubricant coated onto photoconductor drum 413. Note that a known means such as a Fourier transform infrared spectrophotometer (FT-IR), which will be described later, is used to measure the amount of lubricant coated onto photoconductor drum 413. In this way, it is possible to directly maintain the amount of lubricant coated onto photoconductor drum 413 within an appropriate range. Note that control section 100 may also perform control to change the toner removing performance based on a combination of any two or more factors of the coverage rate of the input image, the amount of toner consumption and the amount of lubricant coated onto photoconductor drum 413.

A case has been described in the above embodiment where control section 100 controls toner removing section 416 so as to change the toner removing performance based on the coverage rate of the input image at first supply timing (at the time of normal printing) at which toner is supplied to a toner image formation region in photoconductor drum 413 based on the input image, but the present invention is not limited to this. For example, control section 100 may also perform control to change the toner removing performance between first supply timing at which toner is supplied to the toner image formation region in photoconductor drum 413 and second supply timing at which toner is supplied between (images) the toner image formation region in photoconductor drum 413 and the next toner image formation region. Examples of the second supply timing include timing of forming a correction pattern to detect a positioning error between images, timing of forming a patch image to detect concentration and timing at which upstream color toner on intermediate transfer belt 421 is transferred to photoconductor drum 413 at the transfer nip of the downstream color. Note that the amount of transfer of the upstream color toner at this timing is calculated based on transfer efficiency when the toner is transferred from photoconductor drum 413 to intermediate transfer belt 421 and the reverse transfer efficiency when toner is reversely transferred from intermediate transfer belt 421 to photoconductor drum 413. Control section 100 performs control to change the toner removing performance based on this calculation result.

Control section 100 performs control to change the toner removing performance between the first supply timing and the second supply timing. This is because the coverage rate at the second supply timing is different from (higher or lower than) the coverage rate at the first supply timing and the amount of toner or the amount of lubricant supplied to photoconductor drum 413 changes depending on the image correction pattern and the coverage of the upstream color, and the like.

A case of using cleaning brush 418 has been shown in the above embodiment as an example of toner removing section 416, but the present invention is not limited to this. For example, a roller which is rotatable while in contact with photoconductor drum 413 or a belt capable of running while in contact with photoconductor drum 413 may be used instead of cleaning brush 418. In this case, control section 100 performs control to change the toner removing performance by changing the relative moving speed of the roller or belt with respect to photoconductor drum 413.

Furthermore, a blade similar to cleaning blade 415A may be disposed on the upstream side of cleaning blade 415A in the rotational direction of photoconductor drum 413 and control section 100 may change the elasticity of the blade or change the gap between photoconductor drum 413 and the blade to thereby perform control to change the toner removing performance.

In addition, the above embodiment has merely described a specific example of implementing the present invention, and the technical scope of the present invention should by no means be interpreted restrictively. That is, the present invention can be implemented in various forms without departing from the spirit and scope or principal features of the present invention.

The present invention is applicable to an image forming system composed of a plurality of units including an image forming apparatus. Examples of the plurality of units include a post-processing apparatus, an external apparatus such as a control apparatus connected via a network, and the like.

Lastly, results of evaluation experiments (Examples 1 to 3, Comparative Examples 1 and 2) conducted by the present inventors to confirm effectiveness in the above embodiment will be described.

[Configuration of Image Forming Apparatus According to Examples 1 to 3, Comparative Examples 1 and 2]

Hereinafter, the results of the evaluation experiments will be described. An image forming apparatus having the configurations in FIGS. 1 and 2 are used as an image forming apparatus according to Examples 1 to 3, Comparative Examples 1 and 2. A photoconductor drum, a developing device, an intermediate transfer unit (transfer apparatus), a cleaning blade, a cleaning brush and a toner and the like have been set as follows.

(1) Photoconductor Drum

As the photoconductor drum, a drum-like organic photoconductor was used in which a photosensitive layer made of polycarbonate resin and having a thickness of 25 [μm] was formed on an outer circumferential surface of an aluminum drum-like metal substrate. The photoconductor drum was rotated at a circumferential speed of 400 [mm/sec].

(2) Developing Device

The developing device used herein has a developing sleeve that is driven into rotation at a linear velocity of 600 [mm per minute] and has a configuration in which a developing bias having the same polarity as that of the surface of the photoconductor drum is applied to the developing sleeve and reversal development is performed by a two-component developer.

(3) Intermediate Transfer Unit

The intermediate transfer belt used herein is an endless belt made of polyimide resin having conductivity. A primary transfer roller that makes pressure contact with a photoconductor drum with the belt therebetween is provided, and a primary transfer bias having a polarity opposite to the charging polarity of the toner is applied to the primary transfer roller.

(4) Cleaning Blade

The cleaning blade used herein is made of urethane rubber, and has an impact resilience coefficient of 501[%] (25° C.), a JISA hardness of 70 degrees, a thickness of 2.00

[mm], a free length of 10 [mm], and a width of 324 [mm]. The cleaning blade is brought into contact with the photoconductor drum. The cleaning blade is set to have a contact load of 20 [N/m] and a contact angle of 15 degrees with respect to the photoconductor drum.

(5) Cleaning Brush

The cleaning brush used herein is a conductive fur brush made of a conductive nylon fiber (resistance 108[Ω], a thickness of 20 [μm], a fiber density of 3.0×108 fibers/$m^2$), with brush wool having a length of 3 mm and a roller diameter of ϕ14 [mm]. The rotational direction of the cleaning brush is the same direction (accompanying direction) as that of the photoconductor drum. The relative moving speed of the cleaning brush with respect to the photoconductor drum (linear speed ratio) θ is made to be changeable within a range of 1.1 to 1.75 by controlling the driving current supplied to the driving motor that drives the cleaning brush to rotate.

(6) Toner

The toner of the two-component developer used herein is produced by an emulsion polymerization method, composed of toner particles having a volume-mean particle diameter of 6.5 [μm] and having negative charging property. The resultant obtained by adding 0.2 pts. wt. of zinc stearate to the toner particles as lubricant was used as the toner.

<Effect of Homogenization of Lubricant>

An experiment was conducted regarding the kind of effect the amount of toner supplied onto the cleaning blade has on the amount of lubricant coated onto the photoconductor drum using the above-described image forming apparatus.

The amount of toner supplied to the cleaning blade was changed from 0 [g/$m^2$] to 0.6 [g/$m^2$], the photoconductor drum was caused to make 30 revolutions, and the amount of lubricant coated onto the photoconductor drum was then measured using a Fourier transform infrared spectrophotometer (FT-IR).

Figure 6:
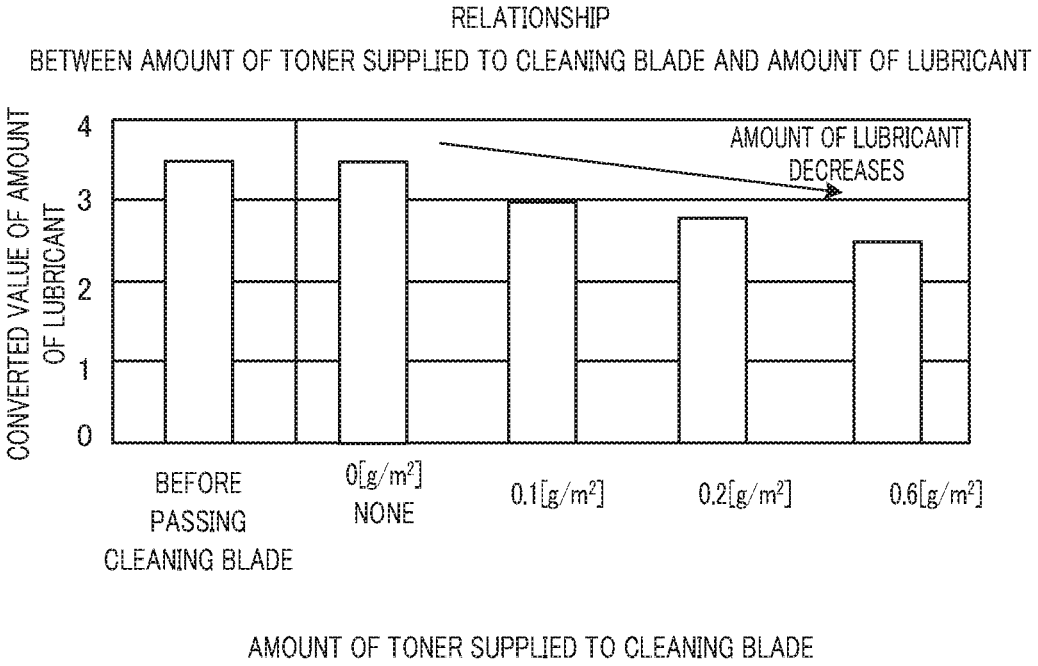
FIG. 6 illustrates a relationship between the amount of toner supplied to the cleaning blade and the amount of lubricant coated onto the photoconductor drum.

FIG. 6 is a diagram illustrating a relationship between the amount of toner supplied to the cleaning blade and the amount of lubricant coated onto the photoconductor drum. As shown in FIG. 6, the amount of lubricant coated onto the photoconductor drum differs depending on the amount of toner supplied to the cleaning blade and the amount of lubricant decreased as the supply amount increased from 0.1 [g/$m^2$] to 0.2 [g/$m^2$], 0.6 [g/$m^2$].

Table 1 shows a configuration and a relative moving speed of the cleaning brush with respect to the photoconductor drum (linear speed ratio) 0 according to Example 1 and Comparative Examples 1 and 2.

TABLE 1

| | Relative Moving Speed of Cleaning Brush (Linear Speed Ratio) θ | | |
|---|---|---|---|
| Coverage Rate of Input Image [%] | Example 1 | Comparative Example 1 | Comparative Example 2 |
| 2 | 1.75 | No Brush | 1.4 |
| 20 | 1.4 | No Brush | 1.4 |
| 40 | 1.1 | No Brush | 1.4 |

In Table 1, "No Brush" in the item "Relative Moving Speed θ" indicates that the cleaning brush is excluded from the configuration. For example, "1.4" of the item "Relative Moving Speed θ" indicates that (circumferential speed of the cleaning brush/circumferential speed of the photoconductor drum) is 1.4 times.

Figure 7:
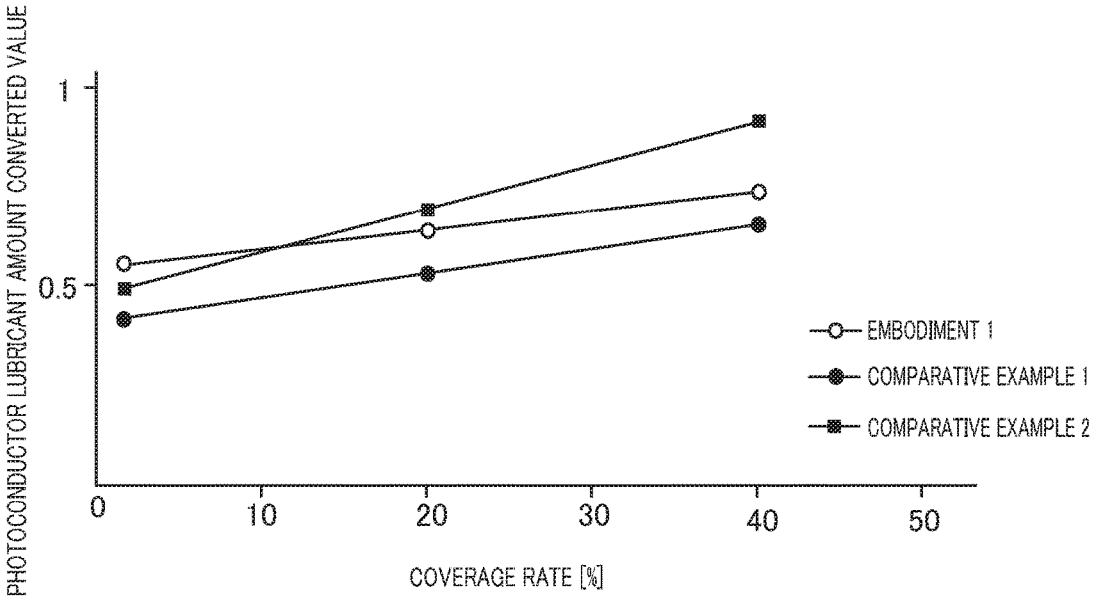
FIG. 7 illustrates a relationship between a coverage rate of an input image and an amount of lubricant coated onto a photoconductor drum (photoconductor lubricant amount converted value).

FIG. 7 illustrates a relationship between the coverage rate of an input image and the amount of lubricant coated onto the photoconductor drum (photoconductor lubricant amount converted value) according to Example 1, Comparative Examples 1 and 2. Note that the photoconductor lubricant amount converted value is based on an FT-IR measured value.

Example 1

Example 1 adopts a configuration with the cleaning blade and the cleaning brush. It is assumed that relative moving speed θ is 1.75 for a low coverage rate of 2[%], 1.4 for a medium coverage rate of 20[%] and 1.1 for a high coverage rate of 40[%].

In Example 1, the amount of lubricant on the photoconductor drum is approximately 0.55 for a low coverage rate of 21[%] and approximately 0.7 for a high coverage rate of 40[%] as shown in FIG. 7. It has been found from above that the difference between the amount of lubricant for the low coverage rate and the amount of lubricant for the high coverage rate is approximately 0.15. This shows that the difference in the amount of lubricant for the low coverage rate and for the high coverage rate according to Example 1 is smaller than the difference in the amount of lubricant for the low coverage rate and for the high coverage rate according to Comparative Examples 1 and 2 (which will be described later) and that the amount of lubricant on the photoconductor drum is maintained to within an appropriate range.

Comparative Example 1

Comparative Example 1 adopts a configuration with only the cleaning blade without the cleaning brush. In Comparative Example 1, the amount of lubricant is approximately 0.4 for a low coverage rate of 21[%] and approximately 0.6 for a high coverage rate of 40[%]. This shows that the difference between the amount of lubricant for the low coverage rate and the amount of lubricant for the high coverage rate is approximately 0.2.

Comparative Example 2

Comparative Example 2 adopts a configuration with the cleaning blade and the cleaning brush. Furthermore, relative moving speed θ is assumed to be fixed to 1.4 irrespective of the coverage rate. In Comparative Example 2, the amount of lubricant is approximately 0.5 for a low coverage rate of 2[%] and approximately 0.9 for a high coverage rate of 40[%]. This shows that the difference between the amount of lubricant for the low coverage rate and the amount of lubricant for the high coverage rate is approximately 0.4.

<Comparison in Effects of Solving Image Problem>

Table 2 shows situations of toner slippage and situations of grain unevenness according to Examples 1 to 3 and Comparative Examples 1 and 2 respectively.

TABLE 2

| | Number of | Coverage Rate of Input Image | | |
|---|---|---|---|---|
| | Passing Sheets | 1 [%] | 5 [%] | 10 [%] |
| Example 1 | 10 | N | N | N |
| | 500 | N | N | N |
| | 2000 | N | N | N |

TABLE 2-continued

| | Number of Passing Sheets | Coverage Rate of Input Image 1 [%] | 5 [%] | 10 [%] |
|---|---|---|---|---|
| Example 2 | 10 | N | N | N |
| | 500 | N | N | N |
| | 2000 | N | N | N |
| Example 3 | 10 | N | N | N |
| | 500 | N | N | N |
| | 2000 | N | N | N |
| Comparative Example 1 | 10 | N | N | N |
| | 500 | "F" Grain Unevenness | N | N |
| | 2000 | "F" Grain Unevenness "F" CL Failure | "F" Grain Unevenness | "F" Grain Unevenness |
| Comparative Example 2 | 10 | N | N | N |
| | 500 | N | N | N |
| | 2000 | "F" Grain Unevenness | N | N |

In Table 2, for example, "10" in the item "Number of Passing Sheets" indicates that the number of continuous prints is 10. "N" in the item "Coverage Rate" indicates that neither toner slippage nor grain unevenness has occurred. ""F" CL Failure" in the same item indicates that a toner slippage has occurred at the coverage rate. Whether toner slippage has occurred was checked based on whether toner slippage noise due to cleaning failure occurred on an image when the number of passing sheets shown in the table corresponding to the coverage rate shown in the table were continuously printed in an environment with a temperature of 10° C. and a humidity of 20[%]. ""F" grain unevenness" in the same item indicates that grain unevenness has occurred at the coverage rate. Whether grain unevenness has occurred was checked based on whether grain unevenness has occurred when one sheet of a half image with a coverage rate of 70[%] was printed immediately after the above-described continuous printing.

Experiment Method and Experiment Result in Example 1

Example 1 adopts a configuration with the cleaning blade and the cleaning brush. It is assumed that relative moving speed θ is 1.77 for a coverage rate of 1[%], 1.7 for a coverage rate of 5[%] and 1.6 for a coverage rate of 10[%].

In Example 1, since relative moving speed θ was assumed to be 1.77 for the coverage rate of 1[%], no grain unevenness occurred when 2000 sheets were continuously printed. Since relative moving speed θ was fixed to 1.4 for the coverage rate of 1[%], this is different from Comparative Example 2 where grain unevenness occurred. By setting relative moving speed θ to 1.77 for the coverage rate of 1[%], the cleaning brush removes a large amount of toner on the photoconductor drum and the amount of toner supplied that reaches (is supplied to) the cleaning blade decreases. This reduced the action of scraping lubricant coated onto the photoconductor drum, maintained the amount of lubricant to within an appropriate range and could thereby prevent the occurrence of grain unevenness.

Experiment Method and Experiment Result in Example 2

Example 2 adopts a configuration with the cleaning blade and the cleaning brush. Furthermore, relative moving speed θ was fixed to 1.4 irrespective of the coverage rate. Furthermore, a bias voltage (+200 [V]) was applied to the cleaning brush. Furthermore, a bias voltage (+400 [V]) was applied to the flicker roller.

In Example 2, no quality problem occurred when 10 to 2000 sheets were continuously printed at a coverage rate of 1[%] to 10[%]. By applying a bias voltage (+200 [V]) to the cleaning brush, the cleaning brush can scrape the toner more easily. Thus, the amount of toner reaching the cleaning blade decreases. This reduces the action of scraping the lubricant coated onto the photoconductor drum, maintains the amount of lubricant to within an appropriate range, and can prevent the occurrence of grain unevenness.

Experiment Method and Experiment Result in Example 3

Example 3 adopts a configuration with the cleaning blade and the cleaning brush. Furthermore, relative moving speed θ was fixed to 1.4 irrespective of the coverage rate. A scorotron charger including a scorotron electrode was provided and a DC+500 [V] was applied to the scorotron electrode.

In Example 3, when 10 to 2000 sheets were continuously printed, no quality problem occurred at a coverage rate of 1[%] to 10[%]. DC+500 [V] is applied to the scorotron electrode, and charge with the charging polarity (minus polarity) and the reverse polarity (plus) is thereby applied to the toner on the photoconductor drum, the charged charge of the toner decreases, whereby the cleaning brush can scrape the toner on the photoconductor drum more easily. For this reason, the amount of toner that reaches the cleaning blade decreases. This reduces the action of scraping the lubricant coated onto the photoconductor drum, maintains the amount of lubricant to within an appropriate range, and can prevent the occurrence of grain unevenness.

Comparative Example 1

Comparative Example 1 excludes the cleaning brush and adopts a configuration with only the cleaning blade. When the number of continuous prints was 10, no quality problem occurred at a coverage rate of 1[%] to 10[%], but when the number of continuous prints was 500, grain unevenness occurred at a coverage rate of 1[%]. Furthermore, when the number of continuous prints was 2000, grain unevenness and CL failure occurred at a coverage rate of 1[%] and grain unevenness occurred at coverage rates of 5[%] and 10[%].

Comparative Example 2

Comparative Example 2 adopts a configuration with the cleaning blade and the cleaning brush. Relative moving speed θ was fixed to 1.4 irrespective of the coverage rate. When the number of continuous prints was 10 and 500, no quality problem occurred at a coverage rate of 1[%] to 10[%], but when the number of continuous prints was 2000, grain unevenness occurred at a coverage rate of 1[%].

REFERENCE SIGNS LIST

1 Image forming apparatus
10 Image reading section
20 Operation display section
21 Display section
22 Operation section
30 Image processing section
40 Image forming section

50 Sheet conveyance section
60 Fixing section
71 Communication section
72 Storage section
100 Control section
101 CPU
102 ROM
413 Photoconductor drum
415A Cleaning blade
416 Toner removing section
417 Scorotron charger
418 Cleaning brush
418B Voltage application section

What is claimed is:

1. An image forming apparatus comprising:

an image bearing member that is rotatable and supplied with toner to which a lubricant comprising a fatty acid metal salt has been added, such that a coating of the lubricant is formed on a surface of the image bearing member;

a first cleaning section configured to make contact with the image bearing member and remove the toner remaining on the image bearing member;

a second cleaning section provided on a downstream side of the first cleaning section in a rotational direction of the image bearing member and configured to make contact with the image bearing member and remove the toner remaining on the image bearing member and not removed by the first cleaning section; and a control section configured to perform control to change removing performance in the first cleaning section based on toner consumption information relating to an amount of toner consumption, wherein an amount of the lubricant which is coated on the image bearing member decreases when an amount of the toner which is removed by the second cleaning section increases.

2. The image forming apparatus according to claim 1, wherein the control section performs control so that the removing performance of the first cleaning section when the amount of toner consumption is small becomes higher than the removing performance of the first cleaning section when the amount of toner consumption is large.

3. The image forming apparatus according to claim 1, wherein:

the toner consumption information is a coverage rate of an input image of an image forming target, and the control section performs control so that the removing performance of the first cleaning section when the coverage rate is low becomes higher than the removing performance of the first cleaning section when the coverage rate is high.

4. The image forming apparatus according to claim 3, wherein the coverage rate is an average coverage rate per predetermined number of printed sheets.

5. The image forming apparatus according to claim 1, wherein the control section changes a relative moving speed of the first cleaning section with respect to the image bearing member to thereby perform control to change the removing performance in the first cleaning section.

6. The image forming apparatus according to claim 1, further comprising a voltage application section configured to apply a voltage to the first cleaning section, wherein the control section changes the voltage to thereby perform control to change the removing performance in the first cleaning section.

7. The image forming apparatus according to claim 1, further comprising a charging amount adjusting section provided on an upstream side of the first cleaning section in the rotational direction of the image bearing member and configured to charge the toner remaining on the image bearing member, wherein the control section changes an amount of charge of the toner to thereby perform control to change the removing performance in the first cleaning section.

8. The image forming apparatus according to claim 1, wherein the control section performs control to change the removing performance in the first cleaning section between a first supply timing at which toner is supplied to an image forming region on the image bearing member and a second supply timing at which toner is supplied between image forming regions on the image bearing member.

9. The image forming apparatus according to claim 1, wherein the first cleaning section comprises a brush which is rotatable while in contact with the image bearing member.

10. The image forming apparatus according to claim 1, wherein the first cleaning section comprises a roller which is rotatable while the first cleaning section is in contact with the image bearing member.

11. The image forming apparatus according to claim 1, wherein the first cleaning section comprises a belt capable of running while the first cleaning section is in contact with the image bearing member.

12. An image forming system comprising a plurality of units including an image forming apparatus, the image forming system comprising:

an image bearing member that is rotatable and supplied with toner to which a lubricant comprising a fatty acid metal salt has been added, such that a coating of the lubricant is formed on a surface of the image bearing member;

a first cleaning section configured to make contact with the image bearing member and remove the toner remaining on the image bearing member;

a second cleaning section provided on a downstream side of the first cleaning section in a rotational direction of the image bearing member and configured to make contact with the image bearing member and remove the toner remaining on the image bearing member and not removed by the first cleaning section; and a control section configured to perform control to change removing performance in the first cleaning section based on toner consumption information relating to an amount of toner consumption, wherein an amount of the lubricant which is coated on the image bearing member decreases when an amount of the toner which is removed by the second cleaning section increases.

13. The image forming system according to claim 12, wherein the control section performs control so that the removing performance of the first cleaning section when the amount of toner consumption is small becomes higher than the removing performance of the first cleaning section when the amount of toner consumption is large.

14. The image forming system according to claim 12, wherein:

the toner consumption information is a coverage rate of an input image of an image forming target, and the control section performs control so that the removing performance of the first cleaning section when the coverage rate is low becomes higher than the removing performance of the first cleaning section when the coverage rate is high.

15. The image forming system according to claim 14, wherein the coverage rate is an average coverage rate per predetermined number of printed sheets.

16. The image forming system according to claim 12, wherein the control section changes a relative moving speed of the first cleaning section with respect to the image bearing member to thereby perform control to change the removing performance in the first cleaning section.

17. The image forming system according to claim 12, further comprising a voltage application section configured to apply a voltage to the first cleaning section, wherein the control section changes the voltage to thereby perform control to change the removing performance in the first cleaning section.

18. The image forming system according to claim 12, further comprising a charging amount adjusting section provided on an upstream side of the first cleaning section in the rotational direction of the image bearing member and configured to charge the toner remaining on the image bearing member, wherein the control section changes an amount of charge of the toner to thereby perform control to change the removing performance in the first cleaning section.

19. The image forming system according to claim 12, wherein the control section performs control to change the removing performance in the first cleaning section between a first supply timing at which toner is supplied to an image forming region on the image bearing member and a second supply timing at which toner is supplied between image forming regions on the image bearing member.

20. A lubricant amount adjusting method comprising:

supplying a rotating image bearing member with toner to which a lubricant comprising a fatty acid metal salt has been added, and forming a coating of the lubricant on a surface of the image bearing member;

removing the toner remaining on the image bearing member by causing a first cleaning section to make contact with the image bearing member;

causing a second cleaning section to make contact with the image bearing member on a downstream side of the first cleaning section in a rotational direction of the image bearing member and thereby removing the toner remaining on the image bearing member and not removed by the first cleaning section; and changing removing performance in the first cleaning section based on toner consumption information relating to an amount of toner consumption, wherein an amount of the lubricant which is coated on the image bearing member decreases when an amount of the toner which is removed by the second cleaning section increases.

* * * * *